US010239104B1

(12) United States Patent
Weisbrodt

(10) Patent No.: US 10,239,104 B1
(45) Date of Patent: Mar. 26, 2019

(54) DEVICE FOR REMOVING DENTS

(71) Applicant: Kenneth Thomas Weisbrodt, Morrow, OH (US)

(72) Inventor: Kenneth Thomas Weisbrodt, Morrow, OH (US)

( * ) Notice: Subject to any disclaimer, the term of this patent is extended or adjusted under 35 U.S.C. 154(b) by 0 days.

(21) Appl. No.: 15/948,201

(22) Filed: Apr. 9, 2018

(51) Int. Cl.
*B21D 1/12* (2006.01)
*B21D 1/06* (2006.01)
*B21D 1/10* (2006.01)

(52) U.S. Cl.
CPC ..... *B21D 1/06* (2013.01); *B21D 1/10* (2013.01); *B21D 1/12* (2013.01)

(58) Field of Classification Search
CPC .... B21D 1/06; B21D 1/12; B21D 1/10; B30B 15/0064
USPC ..... 72/458
See application file for complete search history.

(56) References Cited

U.S. PATENT DOCUMENTS 2,435,726 A * 2/1948 Rohde ..... B21D 1/06 72/470
2,490,254 A * 12/1949 Casazza ..... B21D 1/06 72/453.16
2,539,040 A * 1/1951 Sparhawk ..... B21D 1/06 72/319
2,605,808 A * 8/1952 Current ..... B25D 9/08 173/121
3,100,336 A * 8/1963 Fannin ..... B21D 1/06 29/402.19
4,934,174 A * 6/1990 Gronlund ..... B21D 1/06 254/131
5,201,204 A * 4/1993 Hinterman ..... B30B 15/0064 100/259
5,479,804 A * 1/1996 Cook ..... B21D 1/06 33/608
6,014,885 A * 1/2000 Griffaton ..... B21D 1/06 72/453.16
7,104,108 B2 * 9/2006 Roche ..... B21D 1/06 72/458
7,520,154 B1 * 4/2009 Pallotti ..... B21D 1/10 72/308
7,987,692 B2 * 8/2011 Kiefer, Jr. ..... B21D 1/12 29/267
2005/0252271 A1 * 11/2005 Fredenberg ..... B21D 1/06 72/457

* cited by examiner

*Primary Examiner* — David B Jones
(74) *Attorney, Agent, or Firm* — R. William Graham

(57) ABSTRACT

A tool for removing dents includes a rigid member having first upper handle and a second lower handle extending in a generally opposite direction and interconnect by way of a first lateral rigid bar portion, a second rigid upper bar portion connects to the first lateral bar portion and extends generally in a common direction to the first upper handle thus forming a U shape between the first upper handle, the first lateral rigid bar portion and the second rigid upper bar portion, and a rigid nose head extending from an end of the second rigid bar portion inward generally in a direction toward the first upper handle.

4 Claims, 3 Drawing Sheets

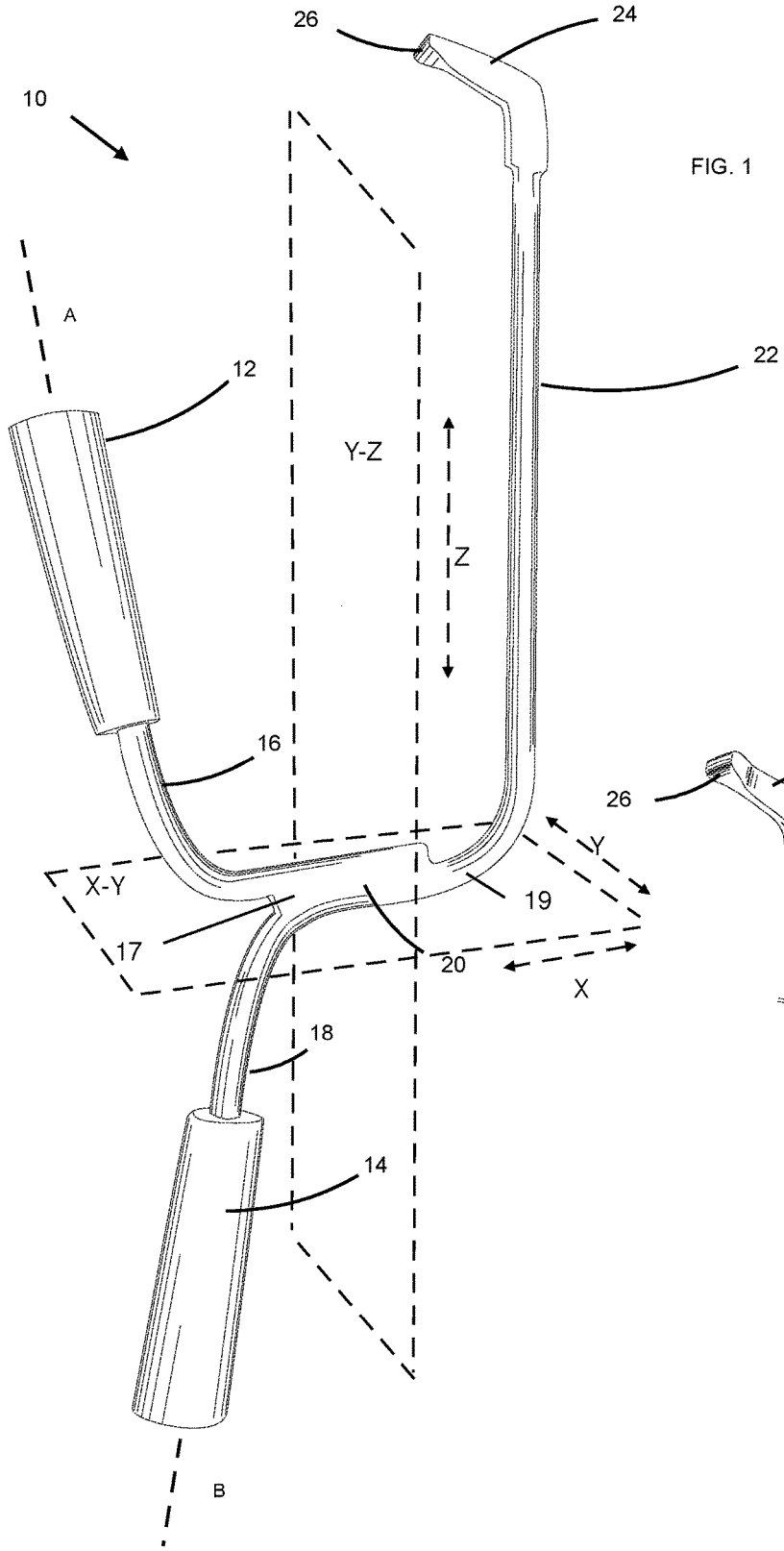
FIG. 1
FIG. 2
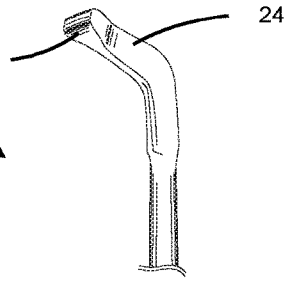

DEVICE FOR REMOVING DENTS

FIELD OF INVENTION

The present invention relates to removal of dents. More particularly, the invention relates to a device for assisting in dent removal.

BACKGROUND OF INVENTION

There exist numerous devices for removing dents. Such devices include hammers, pry bars, suction and pull devices.

SUMMARY OF INVENTION

The present invention provides a device for accomplishing the result of removing dents from metal, such as dents in vehicle bodies and fenders. The present invention is a significant saving of time and expense.

An object of the invention is to provide a device be carried out in a simple manner and in a relatively short space of time.

A further object of the invention is to provide a tool which readily provides both a scraping and tapping dent removal by a dual handled device for pulling outwardly or hitting an inner side of damaged body panel, restoring the dented or bent panel to its ordinary or normal position or approximately thereto.

More specifically, the invention comprises a tool for removing dents. The tool has a first upper handle and a second lower handle extending in a generally opposite direction from the first upper handle and interconnect by way of a first lateral rigid bar portion between the handles and extends laterally outwardly. A second rigid upper bar portion connects to the first lateral rigid bar portion and extends generally in a common direction to the first upper handle thus forming a U shape between the first upper handle, the first lateral rigid bar portion and the second rigid upper bar portion.

A rigid nose head extends from an end of the second rigid bar portion inward generally in a direction toward the first upper handle. The rigid nose head can preferably include a rounded end and of a length suitable to accomplish the purposes intended herein. The handles can be integrally or separately connected as part of rigid handle bar portions. The handles can be configured with finger conforming portions if so desired.

By so providing, the tool enables significant advantages over prior devices with decreased repair time as a result of enhanced functionality. The tool can be utilized in various manners. By way of example, the following is one method of use.

The rigid nose head can be inserted behind a sheet or panel of an automobile, such as a rear quarter panel adjacent an inward dent. Those skilled in the art will understand how to gain access to a rear surface of the panel. The first rigid bar portion extends outside the panel with the second upper rigid bar portion and rigid handle bar portions displaced generally parallel to the panel to be worked and is provided with sufficient clearance to enable the tapping movement of the tool nose head. Then, by grasping the handles, movement of the nose head can be accomplished in several ways by applying a pulling force to draw the nose head into contact with the dent. The handles enable unique pressure to be applied by pushing in on the lower handle while pulling out on the upper handle to cause movement of the rigid nose head inward and then pressure reversed to displace the rigid nose head and by performing this at a rate to perform a tapping/hammering of movement of the nose head. Optionally, both handles may be pulled to apply a scraping/pulling force. By pulling outwardly upon the panel which is damaged or by the tapping of the dent as described above, the dent can be more readily and easily removed from the panel. This results in a significant saving of cost.

Other objects of the invention will appear in the specification and will be more apparent from the accompanying drawings.

BRIEF DESCRIPTION OF THE DRAWINGS

FIG. 1 is a perspective view illustrating a tool of the instant invention.

FIG. 2 illustrates an exemplary nose of the instant invention.

DETAILED DESCRIPTION OF THE PREFERRED EMBODIMENT

Figure 3:
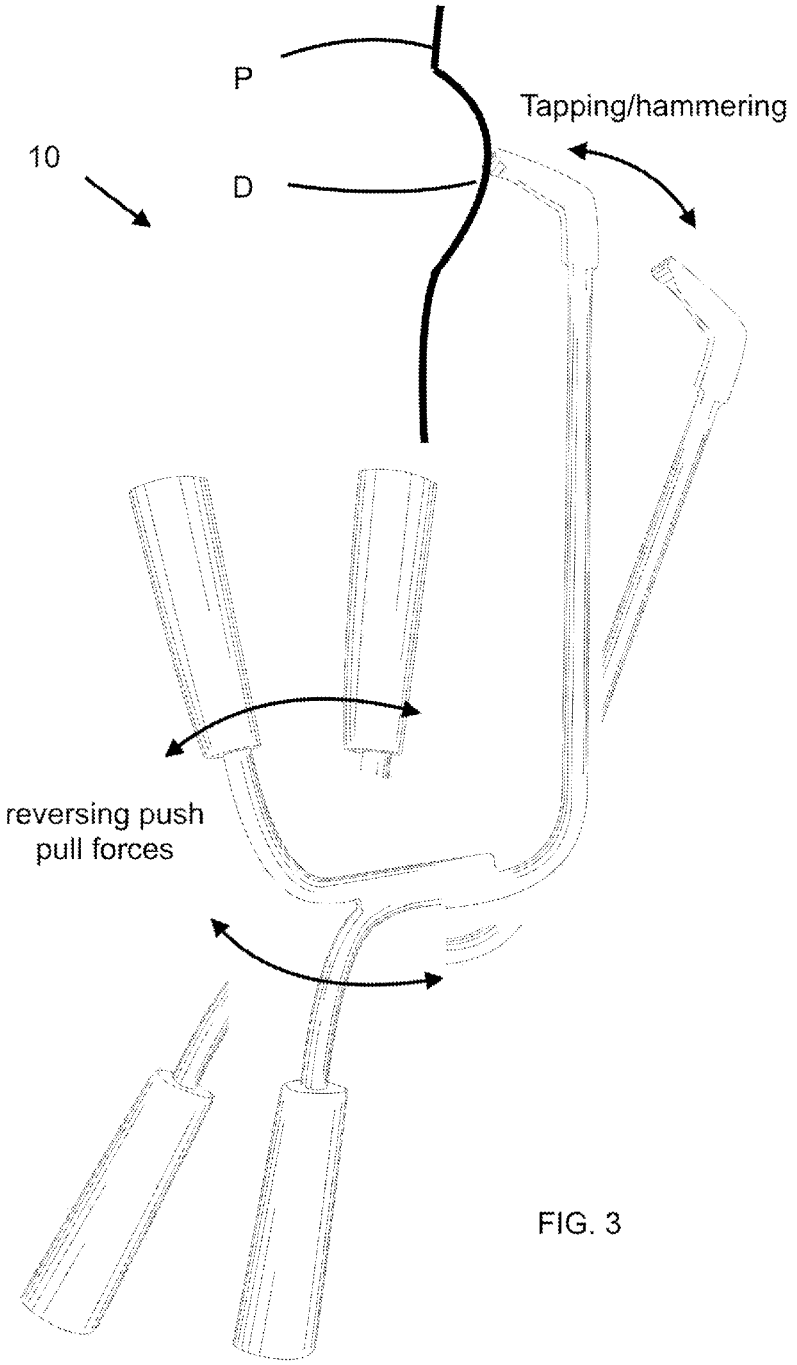
FIG. 3 illustrates an exemplary tapping movement of the tool of the instant invention.

Referring now to the drawings, the tool being a rigid member of the instant invention is generally designated by the numeral 10. The tool 10 can be used for removing a dent D from a panel P.

The tool 10 has a first upper handle 12 defined about a first axis A and a second lower handle 14 defined about a second axis B, the handles 12 and 14 extending in a generally opposite direction outward direction along their respective axis. The handles 12 and 14 can be integrally or separately connected as part of rigid upper handle bar portion 16 and lower handle bar portion 18, respectively. The handle bar portions 16 and 18 can be separate pieces and bonded or welded together or it is contemplated that they may be part of an overall cast made tool. The handles 12 and 14 can be configured with an enhanced gripping surface which lends to their performance such as having a tapered surface or finger conforming portions if so desired.

The handle bar portions 16 and 18 interconnect to a first end 17 of a first lateral rigid bar portion 20 lying in a plane X-Y between the handles 12 and 14 and wherein the handles 12 and 14 are on opposite sides of plane X-Y and the first lateral rigid bar portion 20 extends laterally outwardly to a second end 19, and a second plane Y-Z is defined between the first end 17 and the second end 19 wherein the handles 12 and 14 are on a common side of plane Y-Z with the first axis A and the second axis B shown acute to the plane Y-Z such that the handle 12 extends generally upward in a Z direction and handle 14 extends downward generally in a Z direction. A second rigid upper bar portion 22 connects to the second end 19 of the first lateral rigid bar portion 20 and extends generally in a upward Z direction like the first upper handle 12 thus forming a U shape between the first upper handle 12, the first lateral rigid bar portion 20 and the second upper rigid bar portion 22 with plane Y-Z generally ling between both the second rigid upper bar portion 22 and the first upper handle 12 and the second lower handle 14. An exemplary length of the lateral rigid bar portion can be about 9 inches, and exemplary lengths of the second upper rigid bar portion 22 can be from about 24 inches. Exemplary lengths of the handle bar portions 16 and 18 can be about 12 inches. Exemplary diameter for the handle 12 and 14 can be about 1". Exemplary length of the first lateral rigid bar portion 20 can be about 9" and exemplary length of the second upper rigid bar portion 22 can be about 2'. The gap between an edge of handle 12 and a rounded end 26 can be about 9".

A rigid nose head 24 extends from an end of the second bar portion 20 inward generally in a direction toward the first upper handle 12. The rigid nose head 22 can preferably include rounded end 26 and can be of a length suitable to accomplish the purposes intended herein, for example, about 2' in length, ½" length in width and thickness of about ⅛".

By so providing, the tool 10 enables significant advantages over prior devices with decreased repair time as a result of enhanced functionality. The tool 10 can be utilized in various manners. The following methods of use are exemplary.

Figure 4:
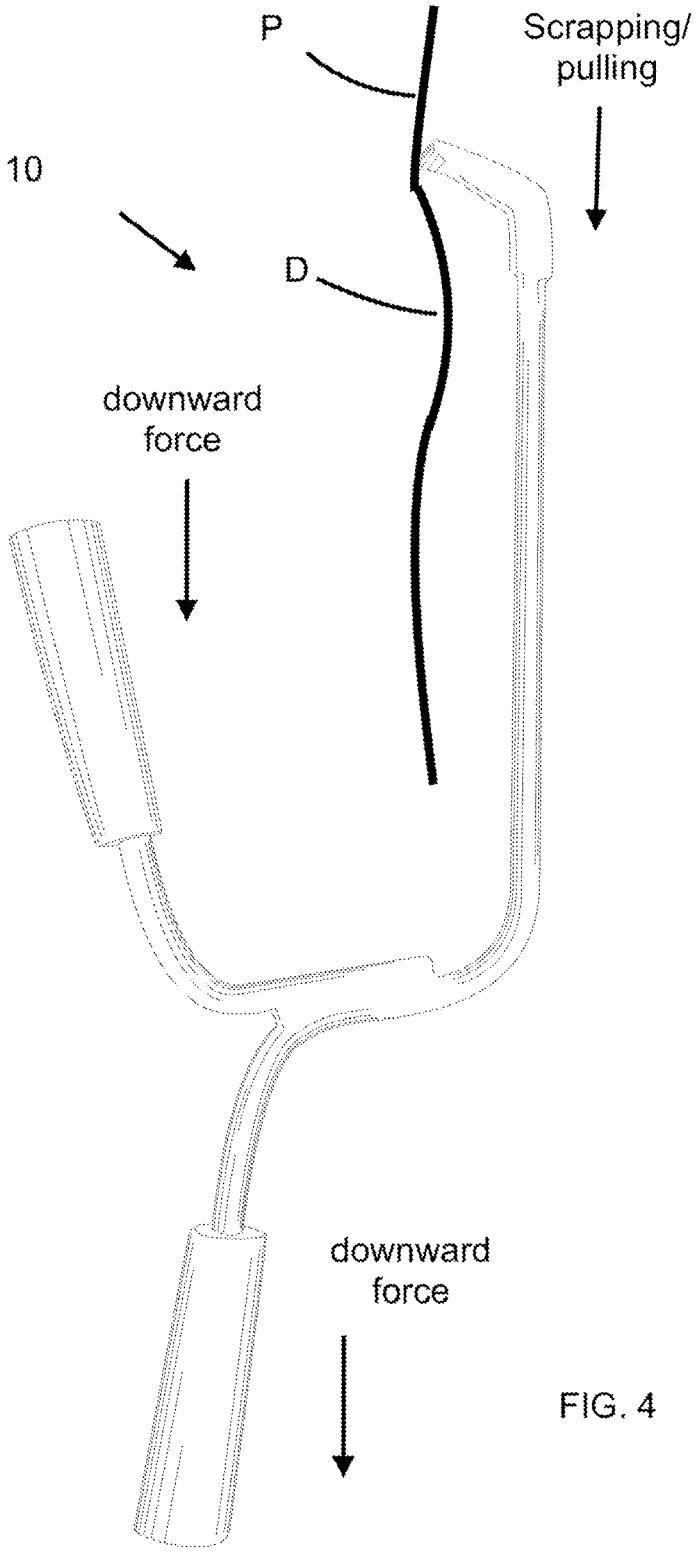
FIG. 4 illustrates an exemplary scrapping movement of the tool of the instant invention.

The rigid nose head 24 can be inserted behind a sheet or panel P of an automobile, such as a rear quarter panel P adjacent an inward dent D. Those skilled in the art will understand how to gain access to a rear surface of the panel P. The first lateral rigid bar portion 20 extends outside the panel P with the second rigid upper bar portion 22 and handle bar portions 16 and 18 displaced generally laterally to the panel P to be worked and is provided with sufficient clearance to enable the tapping movement of the rigid nose head 24 as seen in FIG. 3 or scrapping/pulling as seen in FIG. 4.

By grasping the handles 12 and 14, movement of the rigid nose head 24 can be accomplished in several ways by applying a push/pulling force to draw the rigid nose head 24 into contact with the dent D. The handles 12 and 14 enable unique push/pull pressure to be applied, for example, by pushing in on the lower handle 14 while pulling out on the upper handle 12 to cause movement of the rigid nose head 24 inward and then pressure reversed to displace the rigid nose head 24 and by performing this at a rate to perform a tapping/hammering movement of the rigid nose head 24.

Optionally, both handles 12 an 14 may be pulled to apply a scraping/pulling force. By pulling outwardly upon the dent D which is damaged or by the tapping/hammering of the dent D as described above, the dent D can be more easily and quickly removed from the panel P. This results in a significant saving of cost.

The above described embodiments are set forth by way of example and are not for the purpose of limiting the scope of the present invention. It will be readily apparent that obvious modifications, derivations and variations can be made to the embodiments without departing from the scope of the invention. For example, the configuration, length, width and thickness of the nose head, handle configuration, angles of connected bar portions and materials used to construct the tool can be varied to accomplish the objectives set forth herein and will be apparent to one of ordinary skill in the art. Accordingly, the claims appended hereto should be read in their full scope including any such modifications, derivations and variations.

What is claimed is:

1. A tool for removing dents, which comprises:

a rigid member having first upper handle defined about a first axis and a second lower handle defined about a second axis extending in a generally opposite direction from said first upper handle and interconnect by way of a first end of a first lateral rigid bar portion lying in a first X-Y plane between said handles and wherein said first lateral rigid bar portion extends laterally outwardly to a second end thereof, and wherein said handles are on opposite sides of the first plane, and a second Y-Z plane is defined through the first lateral rigid bar portion normal to the first X-Y plane and said handles are both on a first side of said second plane wherein said first upper handle and said second lower handle extend generally in a Z direction;

a second rigid upper bar portion connects to said second end of said first lateral bar portion and extends generally in a Z direction opposing to said first upper handle thus forming a U shape between said first upper handle, said first lateral rigid bar portion and said second rigid upper bar portion, and said second rigid upper bar portion is on a second side of said second plane; and a rigid nose head extending from an end of said second rigid bar portion inward generally in a direction toward said second plane.

2. The tool of claim 1, wherein said rigid nose head includes a rounded aspect.

3. The tool of claim 1, wherein said handles are one of integrally and separately connected as part of respective rigid handle bar portions.

4. The tool of claim 1, wherein said handles include an enhanced gripping surface.

* * * * *